United States Patent [19]

Grimm

[11] Patent Number: 4,642,896

[45] Date of Patent: Feb. 17, 1987

[54] SEWING AID

[76] Inventor: Susan P. Grimm, 36000 Jefferson, Apt. B-307, Mt. Clemens, Mich. 48043

[21] Appl. No.: 453,586

[22] Filed: Dec. 27, 1982

[51] Int. Cl.[4] ..... A41H 3/00

[52] U.S. Cl. ..... 33/17 R; 33/562

[58] Field of Search ..... 33/11, 12, 17 R, 13, 33/14, 15, 16, 562

[56] References Cited

U.S. PATENT DOCUMENTS

| | | | |
|---|---|---|---|
| 1,419,634 | 6/1922 | Koewing . | |
| 1,529,411 | 3/1925 | Koewing . | |
| 1,747,323 | 2/1930 | Sadtler . | |
| 2,106,895 | 2/1938 | Le Coq et al. | 33/12 |
| 2,411,328 | 11/1946 | MacNab | 33/12 |
| 2,657,159 | 10/1953 | Nahman | 154/95 |
| 2,697,222 | 12/1954 | Reid | 33/12 X |
| 2,756,434 | 7/1956 | Rick et al. | 2/243 |
| 3,095,649 | 7/1963 | Wightwick | 33/12 |

*Primary Examiner*—William D. Martin, Jr.

*Attorney, Agent, or Firm*—Gifford, Groh, VanOphem, Sheridan, Sprinkle & Dolgorukov

[57] ABSTRACT

A method for marking a fabric for sewing, cutting, or the like includes placing a plurality of markers on the fabric at positions instructing how the fabric is to be manipulated. The markers are differentiable according to the instructions to be conveyed, are adhesively backed, and are distinguishable from the fabric when applied. A sewing aid includes a plurality of such markers.

13 Claims, 6 Drawing Figures

SEWING AID

BACKGROUND OF THE INVENTION

I. Field of the Invention

The present invention is directed to an aid for the assembly of a finished garment from fabric and a garment pattern, or for marking alterations on existing garments, and more particularly to such an aid including employing removable, adhesive-backed markers to transfer instructions from the pattern to the fabric, or to mark the garment to be altered.

II. Description of the Prior Art

Patterns for cutting cloth or fabric into pieces for assembly into a finished garment have long been known. Commonly, a paper pattern is affixed to the fabric during such cutting. This paper pattern conventionally bears indicia instructing the assembly of these pieces into a finished garment and includes designations of: the name of the cut piece, such as the sleeve, the skirt, and so on; the location of the piece relative to the garment, such as the front or back; the direction and location of seaming, darting, gathering, easing, buttonholing, and other sewing or cutting; and the like.

Marking or indicating on the cut fabric those positions corresponding to the indicia on the pattern is also known. Various methods for marking exist, but each has its own drawbacks.

For example, straight pins have been used to mark various directions upon cut pieces of fabric, as well as to fasten the fabric in position during fitting. However, such use of straight pins can damage the weave of the fabric through which they are stuck. Additionally, the use of pins often results in discomfort or injury to the garment wearer or assembler when they are stuck by the pins.

Also various methods, including the use of straight pins, are known for altering existing garments. Methods utilizing straight pins and the like are especially difficult when the alterations are being marked by the wearer of the garment without help from others.

Rick et al. in U.S. Pat. No. 2,756,434 disclose the use of a paper pattern which is bonded to fabric by laminating the pattern to the fabric with a thermal bonding tissue disposed therebetween. The fabric is then cut and sewn prior to removal of the pattern from the cloth. The pattern of Rick et al. is necessarily destroyed during the clothing assembling process, and is of no assistance when one wishes to assemble a finished garment from an inexpensive and readily available paper pattern. Moreover, use of a thermal plastic and heat sealable material as in Rick et al. necessitates the use of a warm iron for adhesion to the fabric. Such use may damage either the pattern itself or a delicate fabric. Additionally, adhesive may adhere to the fabric when the pattern is stripped therefrom.

Also the method illustrated in the prior patent is not useful for marking garments for alterations by the wearer of the garment.

Sadtler in U. S. Pat. No. 1,747,323 discloses a garment pattern having a transferable medium (such as ink) printed on the pattern, which medium is transferable to the fabric to be cut and sewn. While the transferable medium does fix the position on the fabric of indicia transferred to the fabric, the pattern is somewhat disadvantageous. The use of the pattern can stain a fabric which is susceptible to the patricular medium used. Further, the indicia so transferred cannot be repositioned while the garment is being fitted to a particular wearer.

SUMMARY OF THE PRESENT INVENTION

The present invention overcomes the above-mentioned drawbacks by providing an aid for assembling a finished garment from cloth, leather, fur etc. and a conventional paper garment pattern, comprising a multiplicity of varously shaped, inscribed, and colored markers which are attached to the cut fabric. The markers are adapted to direct the assembly of the fabric in accordance with the instructions or indicia conventionally present upon the paper pattern. Each of the markers comprises an adhesively-backed material sufficiently thick so as to be distinguishable by feel when employed on thick fabrics, and by sight through thin fabrics. The markers are easily removable from the fabric during or after use, so that the markers can be repositioned during fitting of the garment to an individual wearer.

The method of the present invention is also useful in altering finished garments and permits the garment to be marked for alterations on the wearer of the garment without assistance.

BRIEF DESCRIPTION OF THE DRAWING

A better undertanding of the present invention will be had upon reference to the following detailed description, when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 1:
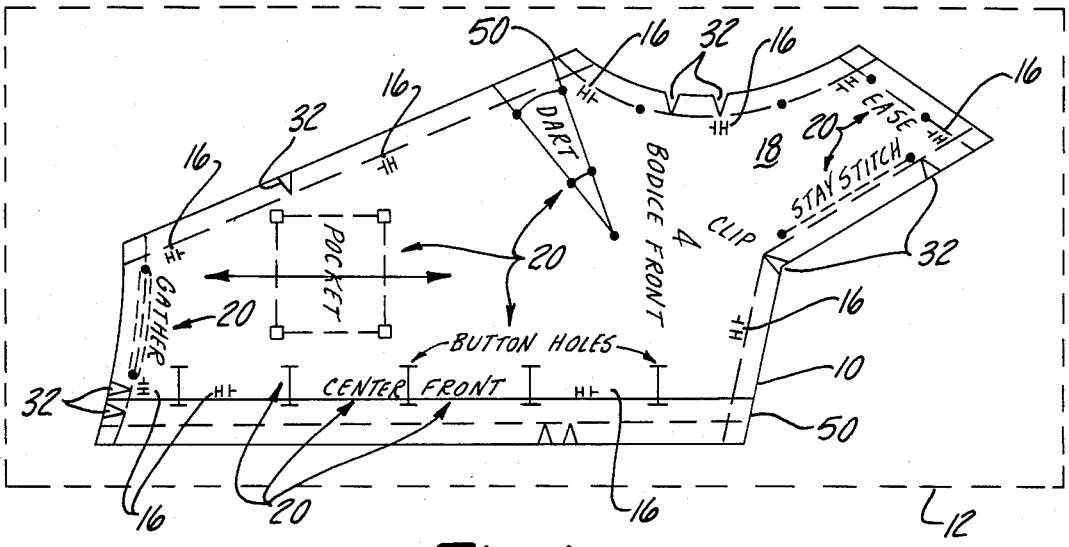
FIG. 1 is a top view of a conventional paper garment pattern attached to a run of fabric.

With reference now to FIG. 1, a conventional paper garment pattern 10 is thereshown, which is of the type used to cut pieces of fabric for assembly into a finished cloth garment (not shown). The garment pattern 10 is attached to a run of fabric 12, for example, by several straight pins 16 passsing through both the pattern 10 and the fabric 12.

Figure 2:
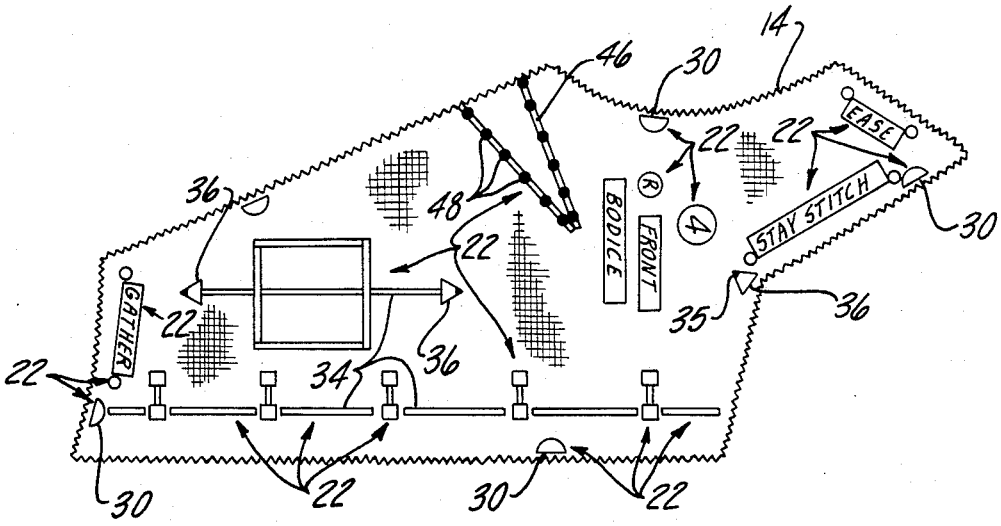
FIG. 2 is a top view of the preferred embodiment of the present invention.

Conventionally, the garment pattern 10 comprises a template 18 from which a particular fabric piece 14 (FIG. 2) is cut.

The pattern 10 bears upon it a multiplicity of markings 20 for instructing assembly of the fabric piece 14 into a finished garment. Although only one fabric piece 14 is shown (see FIG. 2) and described further herein, finished garments often require more than one fabric piece for assembly. For simplicity, only one such piece is shown, although it should be understood that the method of the present invention can be repeated for each of such pieces.

The markings 20 indicate the name or number of the part of the garment (and thus of the corresponding cut fabric piece 14) including the side of the pattern or piece (front or back, inside or outside); the location of buttonholing, darting, fitting adjustment (including easing and gathering), sticthing, pockets, register marks, and the garment centerline; and the direction of alignment with the grain or bias of the fabric.

Figure 4:
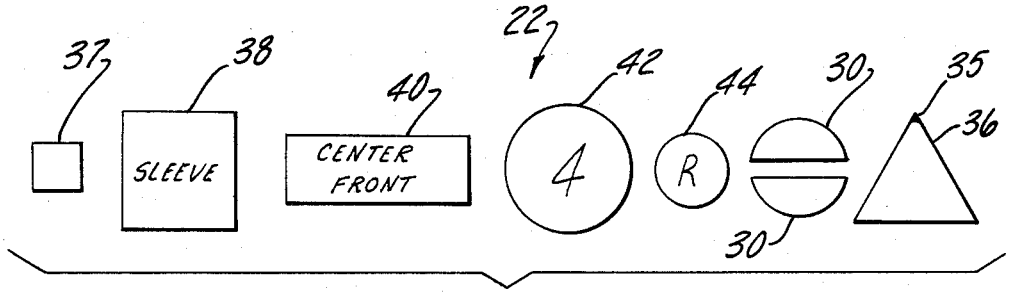
FIG. 4 is a top view of a portion of the preferred embodiment of the present invention.

The preferred embodiment of the present invention comprises the use of a plurality of differentiable markers 22 (FIG. 4) which are attachable to the cut fabric piece 14 for the purpose of directing assembly of the finished garment in accordance with the markings 20. Preferably, a number of the markers 22 which serve to give the same directions are identical to one another.

The markers 22 are distinguishable in several ways, having different shapes, sizes, colors and other visually distinguishing features. They can be written on for special instructions. The markers 22 are relatively thick so as to be perceived and distinguished during attachment. The markers 22 are visible through thin fabric and capable of being felt by the fingers through or against heavier fabric.

Figure 6:
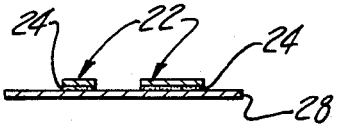
FIG. 6 is a cross-sectional view taken along line 6—6 in FIG. 5.

Each of the markers 22 is backed by a layer of dry adhesive 24 (FIG. 6) which permits the markers 22 to be removably atached to the fabric piece 14. The adhesive 24 is chosen to be one that leaves no residue upon the fabric piece 14 upon removal of the markers 22. The adhesive 24 is preferably a type that permits reattachment of markers 22 to the fabric piece 14, for example, for repositioning of the markers 22 during the fitting of the garment to the wearer.

Figure 3:
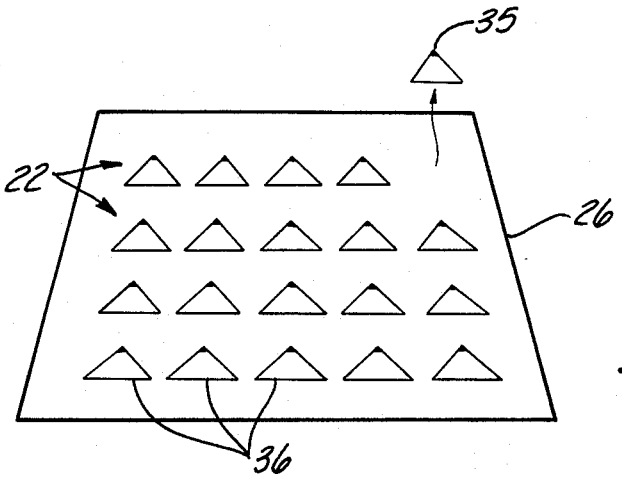
FIG. 3 is a perspective view of a portion of the preferred embodiment of the present invention.
Figure 5:
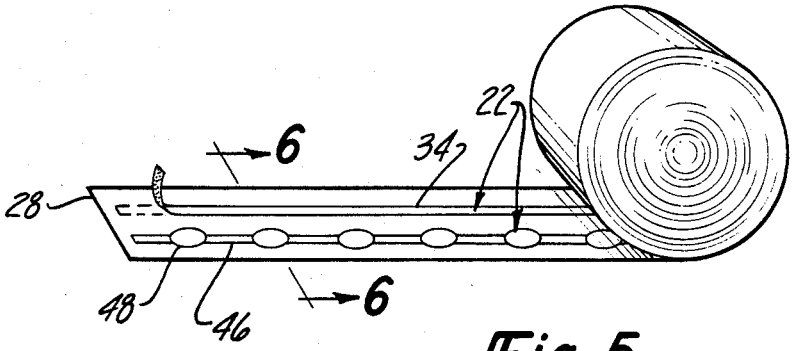
FIG. 5 is a perspective view of another portion of the preferred embodiment of the present invention.

Markers 22 can be supplied as individual pieces having removable paper backing (not shown), but preferably the markers 22 are disposed on a marker supply sheet 26 (FIG. 3) or a marker supply roll 28 (FIG. 5). The markers 22 are then removed from the supply sheet 26 or the supply roll 28 prior to use.

The fact that the markers 22 are distinguishable permits assembly directions to be associated with each of the markers 22. Each of these directions corresponds to the instruction of each of the markings 20 on the pattern 10. For example, a semi-circular marker 30, directing alignment of adjacent fabric pieces during assembly of the finished garment, corresponds to the register notches 32 on the pattern 10.

The others of the markers 22 serve similarly. A straight strip 34, which can be cut to a desired length, indicates the straight, grain, or bias of fabric, and also indicates the location of fold lines or top-stitching. A multiplicity of triangles 36 are used to indicate direction, and have a corner 35 which is designated (for example, by different color) to more clearly indicate direction.

Squares 37 and 38, a rectangle 40, and circles 42 and 44 first identify specific garment pieces such as a sleeve, a bodice, a skirt, and so on. These markers additionally correspond to the pattern markings 20 such as pattern piece number or letter, left ("L") or right ("R"), or front, back or side. These markers also identify the corect or incorrect side of the fabric.

A pair of dotted strips 46 identify dart lines. Preferaby, a plurality of dots 48 on the strips 46 are textured so that upon assembly of the finished garment these strips 46 can be matched by touch alone.

Initially blank markers (such as the markers 30 and 37, and others not shown) can be marked with whatever additional and relevant directions as are necessary.

The method according to the preferred embodiment of the present invention can now be easily understood.

The pattern 10 is attached to the run of fabric 12 by use of the pins 16 inserted through both. The fabric piece 14 is then cut from the run of fabric 12 by cutting the run of fabric 12 along an edge 50 of the template 18. Following this, the pattern 10 is separated from the fabric piece 14 by removal of the pins 16. These steps are well known in the art.

The markers 22 corresponding to the markings 20 on the pattern 10 are then removed from their backings and are placed in positions on the fabric piece 14 corresponding to the markings 20. Once the markers 22 are in place on the fabric piece 14, the piece 14 is then assembled (alone or in conjunction with other fabric pieces) into the finished garment according to the directions of the markers 22.

The garment is fitted to the wearer by repositioning the appropriate markers 22 and reseaming the garment accordingly. Finally, when assembly of the garment is finished, the markers 22 are removed from the finished garment. Preferably, a chosen characteristic of the dry adhesive 24 on the markers 22 is that no residue from the dry adhesive 24 is left on the fabric after their removal.

The markers 22 are preferably of such inexpensive construction that the fitting step can alternatively occur by the application of the new markers to the garment, if the markers 22 are not themselves reusable.

It is also preferred that the markers 22 constructed of a material which permits the markers 22 to be sewn through, either purposefully or accidentally, yet allows the markers 22 to remain removable from the fabric piece 14. This removal can occur, for example, by tearing through the markers 22 after stitching.

If desired, the pins 16 may be removed from the pattern 10 and the fabric piece 14 in only a limited area, so as to keep the pattern 10 and the markings 20 close to the fabric piece 14. This assists correct alignment of the markers 22 with the markings 20 at that limited area.

Use of the markers 22 to transfer directions for assembly of the finished garment from the pattern 10 to the fabric piece 14 results in significant advantages. Use of semi-circles 30 as register marks results in avoiding any erroneous cutting through the register notches 32 beyond the seamline of the pattern. The pattern 10 itself may be used again for assembly of another finished garment. Use of the markers 22 in the fitting, instead of pins 16, prevents discomfort or injury to both the garment wearer and the garment assembler.

The method is additionally advantageous in that confusion is avoided as to which side of the fabric is the correct side, or as to how the fabric grain or bias runs. The method prevents any damage to delicate fabric from occurring which could arise from hot irons, grease pencils, chalk or ink as employed in prior methods. Finally, the method can use any pattern which the garment assembler desires to use, and is not limited to specially prepared or treated patterns.

While it has been preferred to describe the sewing aid of the present invention as being useful in making a garment from a sewing pattern, it should be understood that the sewing aid of the present invention has other uses as well. The sewing aid of the present invention is basically a marking device for marking anything that would be cut, sewn, fused, glued, fitted, altered or assembled.

The sewing aid could, for instance, be used to mark finished garments for alterations and for marking upholstery fabric, slip covers, or the like.

When the markers are used to aid in alterations of finished garments, the person wearing the garment is able to mark the alterations herself by merely adhering the markers while looking into a mirror without attempting to pin the fabric which, depending on the area being altered, is at times difficult or impossible to accomplish without aid.

The markers 22 of the present invention could also be used by cleaners or the like to mark garments or special fabrics prior to cleaning to draw attention to the special care needed for such fabrics, or to locate stains or the like needing special attention.

Having described my invention, however, many modifications thereto will become apparent to those skilled in the art to which it pertains without deviation from the spirit of the invention as defined by the scope of the appended claims.

I claim:

1. A method for assembling a finished garment from cloth and a garment pattern, said pattern comprising at least one conventional template, and said pattern bearing indicia instructing the assembly of said cloth into said garment, said method comprising the steps of:

(a) reversibly attaching said at least one template to said cloth;

(b) cutting said cloth according to said template;

(c) detaching said template from said cloth;

(d) placing a plurality of removable markers upon said cut cloth at positions corresponding to said indicia on said pattern, said markers being adapted to direct the assembly of said cloth in accordance with the instructions of said indicia, wherein said markers are differentiable according to the instructions of the corresponding indicia on said pattern, wherein each of said markers comprises an adhesively-backed material distinguishable by feel or sight from said cloth when applied to said cloth, and wherein said cloth is substantially free of residue upon removal of said markers from said cloth;

(e) assembling said cloth into said finished garment as directed by said markers; and (f) removing said markers from said cloth.

2. The method according to claim 1, wherein step (d) comprises the placing on said cloth of markers which can be sewn through yet which leave said cloth free of residue upon the removal of said marker from said cloth.

3. The method according to claim 1, wherein step (d) comprises the placing on said cloth of markers of at least two different shapes and sizes, so that said markers are differentiable.

4. The method according to claim 1, wherein step (d) comprises the placing on said cloth of markers of at least two different colors, so that said markers are thereby differentiable.

5. The method according to claim 1, wherein step (d) comprises the placing on said cloth of markers of at least two different shapes and sizes, said shapes comprising arrows, squares, circles, strips, rectangles, triangles, or semicircles.

6. The method according to claim 1, wherein step (14) comprises the placing on said cloth of markers bearing visually distinguishing markings thereon.

7. The method according to claim 1, wherein step (d) comprises the placing on said cloth of markers of at least two different shapes and sizes, said markers addition bearing visually distinguishing markings thereon.

8. The method according to claim 1, wherein step (d) comprises the placing on said cloth of markers of at least two different shapes and sizes, said markers additionally being of at least two different colors and said shapes comprising arrows, squares, circles, strips, rectangles, triangles, or semicircles.

9. The method according to claim 8, wherein step (d) further comprises the placing on said cloth of markers which additionally bear visually distinguishing markings thereon.

10. The method according to claim 1, wherein said improvement comprises a step, prior to step (d), of removing the markers as described in step (d) from a marker supply strip.

11. The method according to claim 1, wherein said improvement comprises a step, prior to step (d), of removing a paper covering from the adhesive on each of the markers as described in step (d).

12. The method according to claim 1, wherein step (d) further comprises the placing on said cloth of markers adapted to indicate the lower side or under side of the cloth, the name of a cut cloth piece, the location of a cut cloth piece relative to the garment, the grain and bias of the cloth, the direction and line of sewing, the location of buttonholing, the location of darting, the location of adjustment or individual fitting including easing and gathering, or the location and direction of any additional cutting.

13. The method according to claim 1, comprising the step of fitting the garment to a wearer prior to assembly of the finished garment, and further comprising the repositioning of said markers during said fitting of said garment to said wearer.

* * * * *